US005551117A

United States Patent [19]

Bamman

[11] Patent Number: 5,551,117

[45] Date of Patent: Sep. 3, 1996

[54] FLOOR AND CARPET CLEANING SYSTEM FOR MULTIPLE LEVEL BUILDINGS

[76] Inventor: Harvey W. Bamman, 1910 Virgina Ave., Apt. 1202B, Fort Myers, Fla. 33901

[21] Appl. No.: 452,315

[22] Filed: May 26, 1995

Related U.S. Application Data

[63] Continuation-in-part of Ser. No. 279,292, Jul. 22, 1994, abandoned.

[51] Int. Cl.[6] ..... A47L 5/38

[52] U.S. Cl. ..... 15/302; 15/320

[58] Field of Search ..... 15/301, 302, 314, 15/320; 52/195; 193/33

[56] References Cited

U.S. PATENT DOCUMENTS

| | | | |
|---|---|---|---|
| 357,309 | 2/1887 | Doehring | 15/314 |
| 460,935 | 10/1891 | Cummings | 15/314 |
| 919,606 | 4/1909 | Locke | 15/314 |
| 970,466 | 9/1910 | Clements | 15/314 |
| 980,418 | 1/1911 | Hope | 15/301 |
| 1,026,406 | 5/1912 | Nichols | 15/301 |
| 1,036,378 | 8/1912 | Thurman | 15/301 |
| 1,038,185 | 9/1912 | Nickerson | 15/302 |
| 1,044,707 | 11/1912 | Sutton | 15/301 |
| 1,099,680 | 6/1914 | Weirich | 15/301 |
| 1,255,176 | 2/1918 | Kellogg | 15/301 |
| 1,717,471 | 6/1929 | Spencer | 15/301 |
| 2,156,370 | 5/1939 | Brownfield | 15/314 |
| 2,609,190 | 9/1952 | Jackson | 15/301 |
| 2,725,113 | 11/1955 | Fagyas | 15/314 |
| 2,914,789 | 12/1959 | Scanlan et al. | 15/314 |
| 3,076,068 | 1/1963 | Rackyeft | 15/314 |
| 3,088,484 | 5/1963 | Marsh | 15/301 |
| 3,173,164 | 3/1965 | Congdon | 15/314 |
| 3,483,503 | 12/1969 | Paradiso | 15/314 |
| 3,705,437 | 12/1972 | Reukavina, Jr. et al. | 15/302 |
| 4,580,309 | 4/1986 | Ogden | 15/302 |
| 4,829,626 | 5/1989 | Härkönen | 15/314 |
| 5,075,920 | 12/1991 | Salmon | 15/314 |

FOREIGN PATENT DOCUMENTS

| | | | |
|---|---|---|---|
| 190083 | 6/1964 | Sweden | 15/301 |
| 313640 | 8/1969 | Sweden | 15/314 |
| 139892 | 3/1919 | United Kingdom | 15/314 |
| 411253 | 6/1934 | United Kingdom | 15/314 |

*Primary Examiner*—David Scherbel
*Assistant Examiner*—Tony G. Soohoo
*Attorney, Agent, or Firm*—William E. Noonan

[57] ABSTRACT

A vacuum cleaning system is provided for a multiple level building. This system includes a conduit and raceway mounted inside of the building and arranged vertically to extend through a plurality of levels of the building. There is an inlet connected to the conduit at each level for communicably and releasably engaging one end of a first vacuum hose. The first vacuum hose has an intake nozzle attached at an opposite second end thereof. An outlet is disposed at a level of the building below the upper levels. The outlet communicably and releasably engages one end of a second vacuum hose. The second vacuum hose has an opposite end that is engaged with a vacuum apparatus, which apparatus is operated to create a suction that draws dirt and debris into the apparatus through the system. The raceway is provided adjacent to the conduit and accomodates a solution line in order to provide liquid for cleaning.

17 Claims, 4 Drawing Sheets

FLOOR AND CARPET CLEANING SYSTEM FOR MULTIPLE LEVEL BUILDINGS

RELATED APPLICATIONS

This application is a continuation in part of Ser. No. 08/279,292, filed Jul. 22, 1994, and now abandoned.

FIELD OF THE INVENTION

This invention related to a floor and carpet cleaning system that may be installed in multiple level buildings, such as high rise office buildings, apartments and condominiums. The system may be either installed in new construction or retrofit for use in existing buildings.

BACKGROUND OF THE INVENTION

Conventional vacuum cleaning units usually experience serious limitations when used for apartments, condominiums, high rises and other multi-story buildings. Traditionally, janitorial crews have been required to haul portable vacuum cleaning units up to each floor. This procedure is time and labor intensive and far from efficient. Additionally, portable vacuum cleaners often lack the horsepower and suction required in commercial or industrial business settings.

Mobile janitorial services have employed vacuum units that are mounted in a truck or other service vehicle. These systems eliminate the need to haul the vacuum to the various floors of the building. However, hoses must be run from the vehicle to the respective floors to be cleaned. Typically, the hoses are run up the sides of the building and into windows or through trash chutes. In any case, this technique is again time consuming and often unwieldy. Difficulty may be encountered in deploying the hoses through windows and trash chutes and around corners. This operation becomes even more difficult at great heights. Indeed, mobile vacuum units are normally limited to servicing buildings of 10 floors or less. High pressure solution lines or hoses for washing floors and carpets are also awkward to deploy at such heights.

Central vacuum cleaning units are known wherein vacuum pipes and hoses are constructed in the building. To date, most such units are limited to private residences. It has not been practical to use these systems in high rise structures. Current central vacuum systems often employ intricate piping constructions and are difficult, if not impossible, to retrofit in existing buildings. Moreover, central vacuum units lack the convenience and efficiency of mobile vacuum systems. Unlike vehicle-mounted vacuums, the debris collected by the central vacuum unit is not disposed of immediately. Instead, personnel must periodically remove debris from the vacuum apparatus and prepare the waste for disposal.

Rukavina, Jr. et al., U.S. Pat. No. 3,705,437, discloses a central vacuum system wherein a pressure line and a vacuum line extend between a lower level and a single upper level. The respective lines are fully exposed and unattractive. Moreover, they extend only between two floors. To date, no known system efficiently integrates the vacuum hoses and solution lines fully within the walls of the building such that they are totally hidden. Also, no convenient systems are known for servicing high rises having three or more separate levels.

SUMMARY OF INVENTION

It is therefore an object of this invention to provide a floor and carpet cleaning system for multiple floor buildings that is significantly easier, more efficient, and more convenient to use than previous systems.

It is a further object of this invention to provide a floor and carpet cleaning system for multiple floor buildings that eliminates the need to run bulky and unwieldy vacuum and solution lines up the sides of the building.

It is a further object of this invention to provide a floor and carpet cleaning system that is effective for use in high rise structures of virtually any height.

It is a further object of this invention to provide a vacuum cleaning system for multiple floor buildings that exhibits more effective suction and dirt collection than is achieved by conventional portable vacuum units.

It is a further object of this invention to provide a vacuum cleaning system for multiple floor buildings that enables collected dirt and refuse to be immediately removed from the building by a mobile vehicle without requiring separate collection, as is required in conventional central vacuum units.

It is a further object of this invention to provide a vacuum cleaning system for multiple floor buildings that may be effectively constructed in new buildings or retrofit for use in existing structures.

It is a further object of this invention to provide a vacuum cleaning system that is effective for multiple story buildings having three or more levels.

It is a further object of this invention to provide a vacuum cleaning system comprising a solution line and a vacuum line that are efficiently, attractively and neatly hidden within the walls of the building.

This invention features a vacuum cleaning system for a multiple level building. The system includes a conduit that is mounted to the building and arranged to extend vertically through a plurality of levels of the building. There are a plurality of vacuum inlets connected to the conduit. Each vacuum inlet is disposed in a corresponding upper level of the building and is communicably and releasably engageable with one end of a first vacuum hose. The first vacuum hose has an intake nozzle attached at an opposite second end thereof. An outlet is connected to the conduit in a lower level of the building below the upper levels. The outlet is communicably and releasably engageable with one end of a second vacuum hose. The second vacuum hose has an opposite end that is engageable with a vacuum apparatus. The vacuum apparatus, which is mounted on a mobile service vehicle, operates to create a suction that draws dirt and debris into the apparatus through the system.

In a preferred embodiment, the inlet includes a pipe section that extends transversely from the conduit means. The inlet may also include a fitting having a passageway for communicably interconnecting the transverse pipe section with the first end of the first vacuum hose. The pipe section may include an insertible portion and the fitting may include, at one end, a mouth for receiving the insertible portion and, at an opposite end, means for communicably interengaging the first end of the hose. A closure may be provided for engaging and closing the pipe section when the first hose is detached from the conduit.

This invention also features a floor and carpet cleaning system for a multiple level building wherein a vacuum conduit is mounted inside a wall of the building, between inside and outside wall surfaces and arranged vertically to extend through a plurality of levels of the building. The conduit is separate from and extends through a vertical passageway formed through the wall of the building. There is at least one upper vacuum hose connector unit. Each such unit is disposed in a corresponding upper level of the building and includes an inlet connected to the conduit and communicably and releasably engageable with one end of a first vacuum hose. Again, the first vacuum hose has an intake nozzle attached to an opposite second end thereof. The upper vacuum hose connector unit also includes a housing permanently mounted in the wall of the building and at least partly enclosing the inlet. The housing has an opening, which provides access for the first vacuum hose to engage the inlet. A lower vacuum hose connector unit is disposed in a level of the building below the upper levels. The lower vacuum hose connector unit includes a vacuum outlet connected to the conduit and communicably and releasably engageable with one end of a second vacuum hose. The second vacuum hose has an opposite end that is engageable with a vacuum apparatus that may be located in a mobile service vehicle. As in the previous embodiment, the vacuum apparatus is conventionally operated to create a suction which draws dirt and debris into the apparatus through the system.

Preferably, the vertical passageway accommodates a vertical trash chute that extends through the raceway. The conduit means and the vacuum connector units are disposed externally adjacent to the trash chute.

The housing may include a door for selectively closing and opening when the hose is disengaged from the corresponding inlet. The structure of the conduit means, the inlets and the outlet is analogous to that in the previously summarized embodiment.

The second embodiment may further include raceway means that are mounted inside the walls of the building adjacent to the conduit means. The raceway means may include a plurality of raceway outlets. At least one raceway outlet is disposed in each housing adjacent to the inlet for removably receiving a solution line therethrough. Each raceway outlet may include a pipe segment that is connected to and extends transversely from the raceway. At least one pipe segment is preferably disposed at an upward angle from the raceway and at least one pipe segment is preferably disposed at a downward angle from the raceway.

The lower vacuum hose connector unit may also include a lower housing permanently mounted in the wall of the building, at least partly enclosing the outlet. The lower housing has an opening, which provides access for the second vacuum hose to engage the outlet. Typically, a door is omitted from the lower outlet housing. The vacuum outlet may include a pipe section that extends transversely from the conduit means and a fitting having a passageway for communicably interconnecting the transverse pipe section with the second vacuum hose. This fitting is normally permanently secured to the pipe section of the outlet by an adhesive or other means.

Means may be provided for selectively closing the inlet when the first vacuum hose is disengaged therefrom. Such closure means typically include a cap that is releasably engaged with the pipe section of the inlet.

DETAILED DESCRIPTION OF PREFERRED EMBODIMENTS

Other objects, features and advantages will occur from the following description of preferred embodiments and the accompanying drawings, in which.

Figure 1:
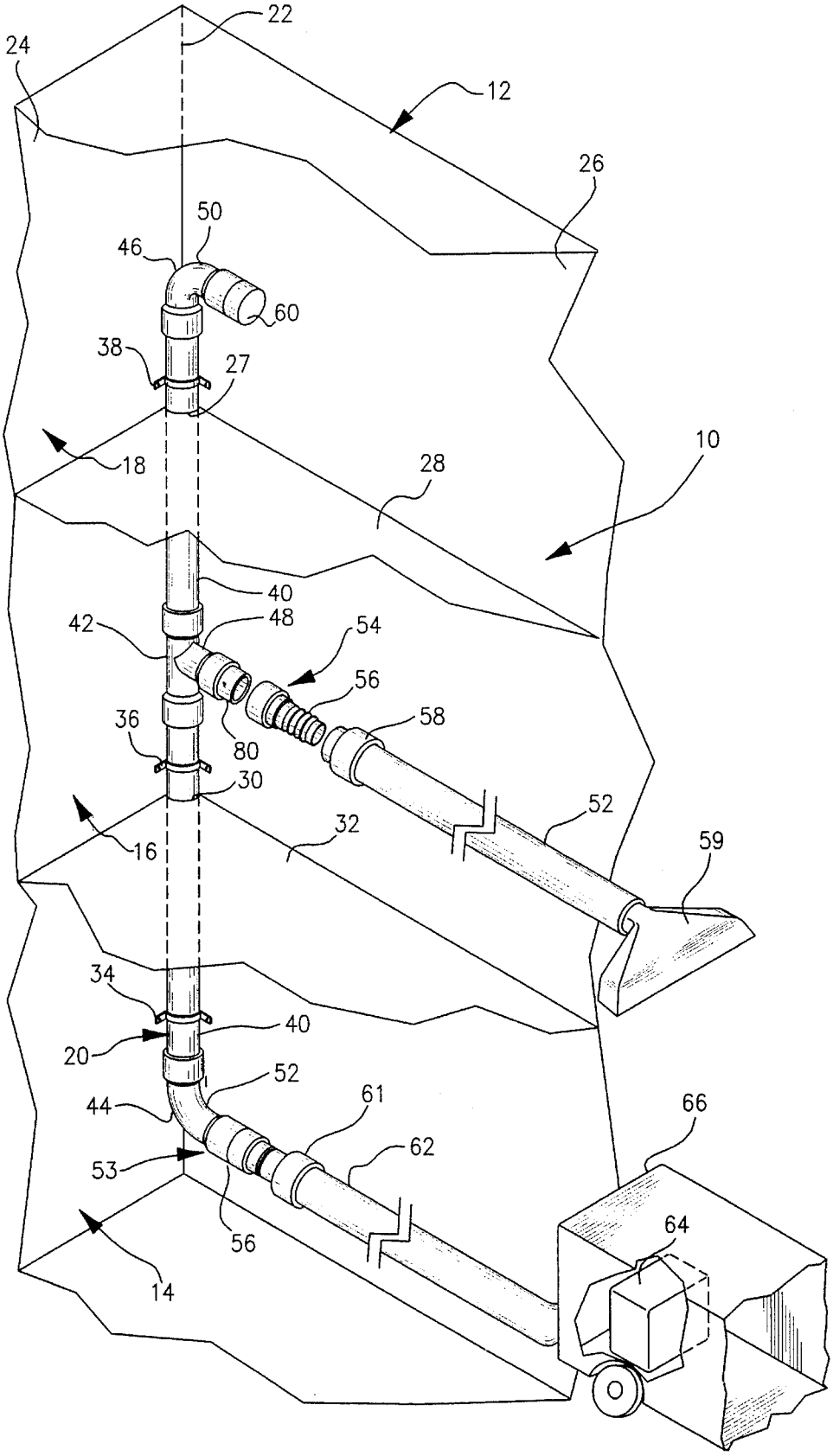
FIG. 1 is a perspective, partly schematic view of a retrofitted vacuum cleaning system according to this invention.

There is shown in FIG. 1 a vacuum cleaning system 10 that is retrofit in a multi-level building 12. The building may comprise a high rise apartment, condominium or office building that includes a plurality of vertically arranged floors or levels 14, 16 and 18. For simplicity and clarity, three levels are illustrated in FIG. 1. However, it should be understood that the precise number of levels in the building is not a limitation of this invention. The structure of system 10 may be used in a wide variety of multiple level buildings and is particularly effective for use in high rise buildings having more that 10 stories. In the embodiment illustrated in FIG. 1, level 14 and level 18 represent the ground and top floors of building 12. Level 16 is an intermediate upper level floor that is located between ground level 14 and top level 18. Each of the intermediate upper levels in the building employs structure that is similar to that shown in level 16.

System 10 includes an elongate conduit 20 that is mounted in a corner 22 of building 12, at the junction of walls 24 and 26. The conduit extends vertically through levels 14, 16 and 18. An opening 26 is formed in the floor 28 of level 18 and a similar opening 30 is formed in the floor 32 of level 16 for accommodating conduit 20. The conduit is attached to the adjoining walls 24 and 26 and is held securely in corner 22 by a plurality of U-clips 34, 36 and 38 that are engaged with conduit 20 and attached to walls 24 and 26 in levels 14, 16 and 18, respectively.

Conduit 20 is preferably composed of a plurality of segments of 2" PVC pipe. Alternatively, various other pipe materials that are suitable for use in vacuum operations may be employed. Preferably, the pipe material should be durable and yet lightweight so that it will remain securely in place in corner 22. More particularly, conduit 20 includes a plurality of generally straight pipe segments 40 that are joined in a communicable, end to end manner by T-connectors 42. One such T-connector is located on each level. An L-shaped pipe element 44 is carried at the lower end of conduit 20 and a similar L-shaped pipe element 46 is carried at the upper end of the conduit. The T-connectors and L-shaped pipe elements are conventional PVC fittings that are manufactured and connected together in a manner that will be known to those skilled in the art. Appropriate PVC adhesives may be employed to securely fasten the adjoining pipe segments. T-connector 42 and L-shaped elements 44 and 46 are attached to the straight pipe segments 40 such that a leg from each of the elements 42, 44 and 46 extends transversely toward the interior of the respective level in which that element is mounted. For example, T-connector 42 includes a transverse section 48 that extends toward the interior of level 16; element 46 includes a transverse section 50 that extends into level 18; and element 44 includes a transverse section 52 that extends toward the interior of ground level 14. In alternative embodiments, element 44 may be configured such that leg 52 extends through an opening in one of the walls 24 and 26 such that the transverse pipe section is exposed outside of building 12.

In each of the upper levels 16 and 18 of building 20, an inlet is formed in conduit 20, which permits a first vacuum hose 52 to be releasably and communicably connected to the conduit. Inlet 54 disposed in level 16 includes transverse pipe section 48 and a fitting 56 that is releasably and communicably interengaged with pipe section 48. The opposite end of fitting 56 is releasably and communicably engaged with a plug 58 at the first end of hose 52. The opposite end of the vacuum hose includes a conventional cleaning head or nozzle 59.

An analogous inlet may be utilized on level 18 for attaching a hose to the conduit on that level when cleaning is required. The inlet on level 18 is defined by transverse pipe section 50 and a fitting similar to fitting, 56, which selectively interengages pipe section 50 and a vacuum hose in a manner that will be described more fully below. In FIG. 1, the vacuum hose is connected to conduit 20 on level 16 only. The fitting, 56 is removed from pipe section 50 and a cap 60 is engaged with pipe section 50 to close the inlet on level 18.

On level 14, a vacuum outlet is defined by transverse pipe section 52 and a second fitting 56 that communicably interengages the lower end of the conduit 20 with a plug 61 at one end of a second vacuum hose 62. The opposite end of hose 62 is operably connected to a vacuum apparatus 64, which is mounted in a mobile vehicle 66.

Figure 2:
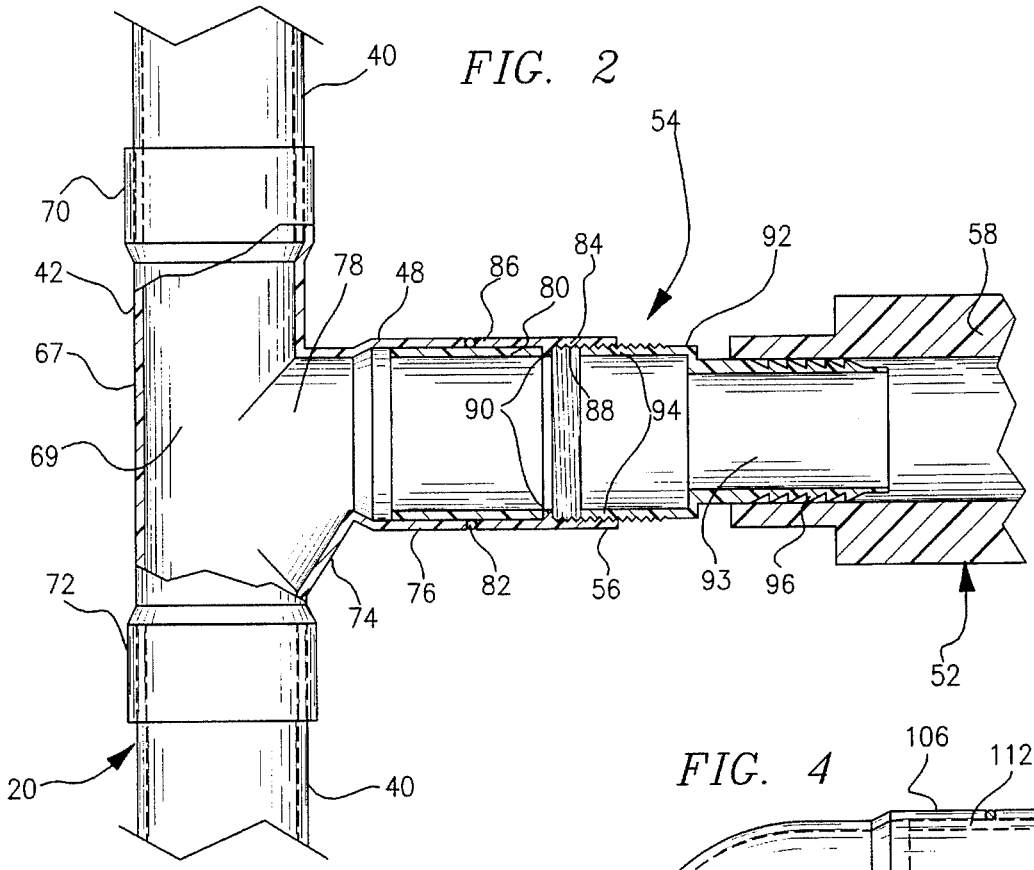
FIG. 2 is an elevational, cross sectional view of a preferred construction for the vacuum inlet of the invention, as interengaged with a conduit and a first vacuum hose.

FIG. 2 illustrates in greater detail a representative T-connector 42 and inlet 54 for communicably interconnecting conduit 20 with end 58 of vacuum hose 52. Connector 42 includes a main portion 67 having a central bore 69. Flange sections 70 and 72 formed at opposite ends of main section 67 receive respective straight conduit sections 40 to define the conduit. Additional T-connectors are formed at other intermediate, upper level locations of the building. And, as previously described, L-shaped pipe elements are attached at the upper and lower floors to complete the conduit.

Inlet 54 is constructed as follows. Transverse conduit section 48 includes a branch pipe portion 74 that is unitarily connected to main pipe portion 67 and has a flange 76 at the distal end thereof. Branch portion 74 also includes an interior channel 78 that communicates with central bore 69 of main section 67 and therefore with the entire conduit. An annular sleeve 80 (see also FIG. 1) is received by flange 76 and is secured therein by an appropriate adhesive. Sleeve 80 is composed of a material that is similar to the T-connector. An O-ring 82 surrounds sleeve 80 and abuts against the distal end of flange 76.

Fitting 56 is removably engaged with transverse section 48. Specifically, fitting 56 includes an annular collar 84. The inner surface of collar 84 includes a smooth first portion 86 and a threaded second portion 88 that are divided by an annular rib 90. Smooth portion 86 slidably engages the smooth outer surface of sleeve 80 such that fitting 56 is engaged with transverse section 48. A relatively close tolerance fit is provided, which permits collar 84 to snugly grasp sleeve 80. The fit is tight enough so that fitting 56 does not become inadvertently disengaged from transverse section 48. At the same time, the tolerance is such that the fitting can be removed using a modest degree of force.

An adapter piece 92 is connected to collar 84. Piece 92 has a central bore 93 and includes a threaded end 94 that engages with and locks into the complementary threaded portion 88 of collar 84. A plurality of locking ribs 96 are formed circumferentially about piece 92 proximate the opposite end of the adapter piece. This end is fitted into plug 58 of conventional vacuum hose 52. The locking grips 96 engage the interior surface of hose plug 58 and enable the adapter piece to securely grip the vacuum hose. The locking ribs are pointed in a direction that permits the vacuum hose to be relatively easily attached onto the adapter piece and which prevents the hose from becoming unintentionally detached. At the same time, the grip is lose enough the permit the hose to be removed by using a modest degree of force. Collar 84 of fitting 56 is again composed of a material similar to the conduit. In most cases this is PVC pipe. The adapter piece 92 is constructed of a suitable synthetic material. The vacuum hose is normally constructed from a relatively pliable plastic or rubber material.

Fitting 56 includes a central bore or opening that is defined through collar 84 and adapter piece 92. Similarly, an open passageway is provided from bore 69 to fitting 56 through bore 78 and the central opening of sleeve 80. As a result, when fitting 56 is connected to transverse conduit section 48 and vacuum hose 52 is connected to fitting 56, communication is established between conduit bore 20 and vacuum hose 52.

Figure 3:
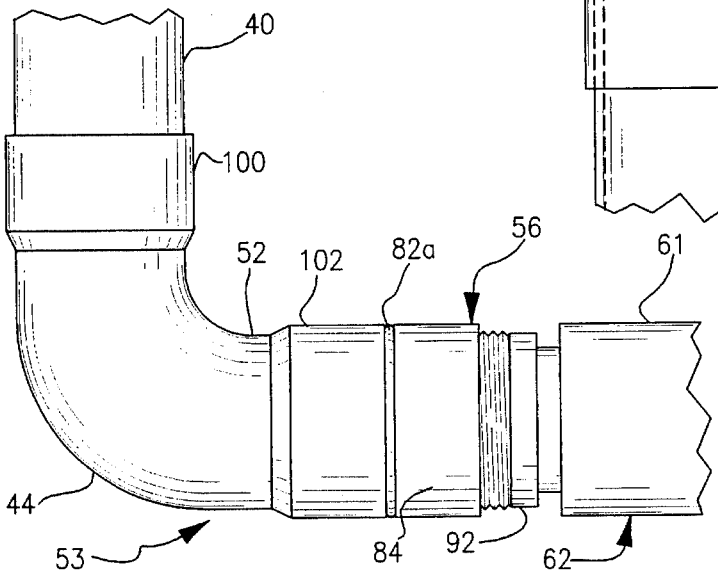
FIG. 3 is an elevational view of the vacuum outlet interengaged with the conduit and a second vacuum hose.

It should be understood that the above principles apply to any other T-connector inlets utilized in system 10, as well as to L-shaped inlet 50, shown in FIGS. 1 and 3. A similar construction is also employed for outlet 53 formed at the lower end of the conduit. This permits a vacuum hose 52 to be connected to any one of the inlets so that the floor or level associated with that inlet may be vacuumed. At the same time, a second hose 62, FIG. 1, is likewise interconnected between outlet 53 and vacuum apparatus 64, when any of the floors of building 12 require vacuuming.

As shown more clearly in FIG. 3, L-shaped pipe section 44 formed at the lower end of conduit 20 includes a flange 100 that interengages the lower end of a straight pipe section 40. Pipe section 44 again includes a through channel as is conventional with these types of pipes or conduits. At the opposite end, section 44 includes a second flange 102 that is analogous the flange 48 in T-connector 42. Flange 102 receives an annular sleeve, not shown, that resembles sleeve 80 shown in FIG. 2. This sleeve is secured to flange 102 by an appropriate PVC adhesive such that the central opening of the sleeve communicates with the bore of pipe section 44. A second fitting 56 interconnects pipe section 44 to end plug 61 of second vacuum hose 62. Such interconnection is accomplished in a manner similar to the interconnection of the conduit and the first hose depicted in FIG. 2. Specifically, collar 84 is fitted onto the annular sleeve carried by flange 102. The collar and flange abut and are separated by O-ring 82*a*. Adapter piece 92 is again fitted into the open end of vacuum hose 62. The adapter piece includes the ribs 96 shown in FIG. 2, which engage and grip the interior circumferential surface of hose 62. As a result, communicable interconnection is established between pipe section 44 and vacuum hose 62.

Outlet 53 always requires use of a fitting 56 during vacuuming. Therefore, fitting 56 may be permanently attached to transverse pipe section 52. This is accomplished by employing an appropriate adhesive to secure collar 84 to the sleeve carried by flange 102. In contrast, the inlets in the upper floors require a fitting 56 only when vacuuming of a respective level is performed. When an upper level is not being vacuumed, a vacuum hose is not required. Fitting 56 is removed and the inlet capped as depicted on level 18 of FIG. 1.

Figure 4:
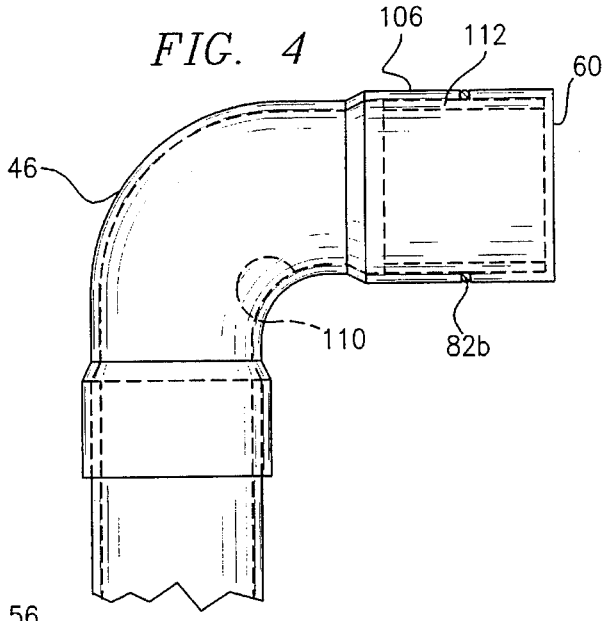
FIG. 4 is an elevational, partly cross sectional view of a top floor inlet with the fitting portion removed and a closure engaged therewith.

A capped inlet is shown in greater detail in FIG. 4. Therein, the L-shaped pipe element 46 located on the top floor is capped. Specifically, pipe element 46 terminates in a flange 106 and includes a central bore 110. An annular sleeve 112, which is analogous to the sleeves discussed in connection with FIGS. 2 and 3, is permanently secured to flange 106 such that it extends outwardly therefrom. Cap 60 is fitted on sleeve 112 such that the inner circumference of the cap engages the outer circumference of the sleeve and the rim of the cap engages O-ring 82*b* formed about the outer rim of flange 106. A relatively close tolerance fit is provided between cap 60 and sleeve 112, which fit resembles that exhibited between collar 84 of fitting 56 and sleeve 80 in FIG. 2. As a result, cap 60 is held snugly on sleeve 112 but can be selectively removed therefrom by the use of a modest amount of force.

To operate system 10, a fitting 56 is attached to the transverse pipe section on one of the upper levels and a corresponding vacuum hose is attached to the other end of that fitting. In the embodiment depicted, level 16 has been selected for vacuuming. Therefore, fitting 56 is attached to transverse pipe section 48 and hose 52 is attached to the opposite end of the fitting. The remaining inlets are capped or closed, such as is exhibited on top level 18 in FIGS. 1 and 4. In alternative embodiments, a fitting, 56 and hose 52 may be attached to the element 46 and the inlet on level 16 may be capped in a manner analogous to that shown in FIG. 4 (i.e. in FIG. 2 fitting 56 would be removed from transverse pipe section 48 and a cap 60, FIG. 4, would be replaced over sleeve 80). Outlet 53, FIGS. 1 and 3, is interconnected to second vacuum hose 62 in the manner described above. Vacuum 64 is then operated to create a suction, which draws dirt and debris into vacuum 64 through the system. Specifically, when vacuuming on level 16, dirt and debris is drawn through nozzle 60 into hose 52. The dirt then proceeds through inlet 54, conduit 20, outlet 53 and hose 62, into vacuum 64. When vacuuming on level 16 is completed, vacuum hose 52 and fitting 56 are removed from transverse section 48 and, if required, are moved to another level for vacuuming. If level 18 requires vacuuming, cap 60 is removed and fitting 56 and hose 52 are attached to transverse section 50. Cap 60 is then fitted onto transverse section 48 in level 16, as previously described. Vacuum 64 is reactivated and vacuuming on level 18 is performed.

It is critical that while vacuuming is being performed on a particular level, the inlets on the remaining levels remain capped or otherwise closed. As a result, suction is created only through the vacuuming hose and not through uncovered inlets on the other levels. This maintains a suitable level of suction through the system. Although caps or closures are disclosed herein, valves and various other mechanisms may be used to close particular inlets when vacuuming is performed but those inlets are not in use.

Figure 5:
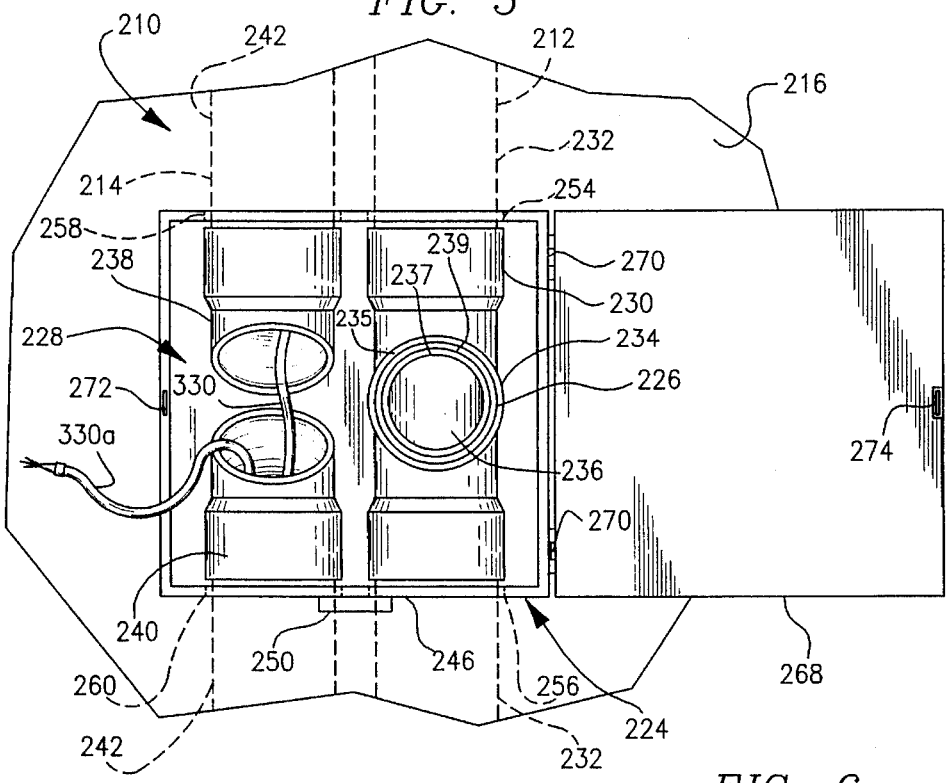
FIG. 5 is an elevational view of a wall mounted unit that includes a vacuum inlet and a pair of raceway outlets employed by an alternative embodiment of this invention.
Figure 7:
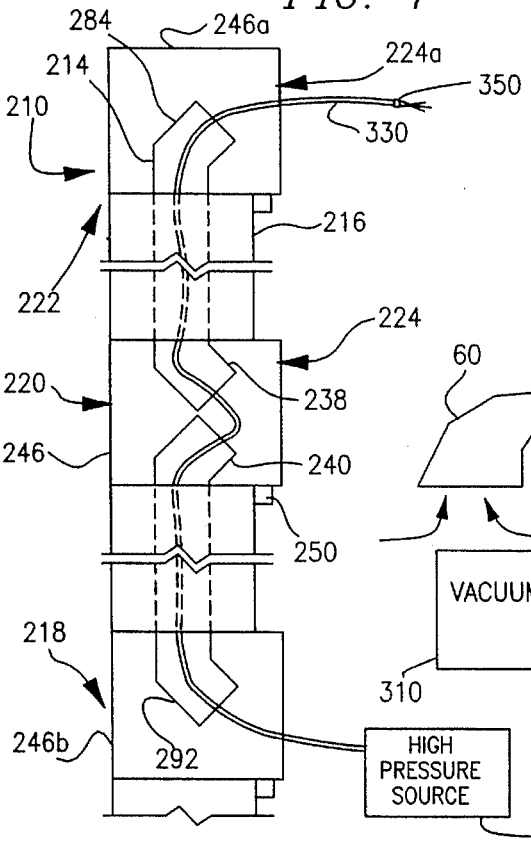
FIG. 7 is a side view, opposite to FIG. 6, which illustrates the solution line raceway system.
Figure 6:
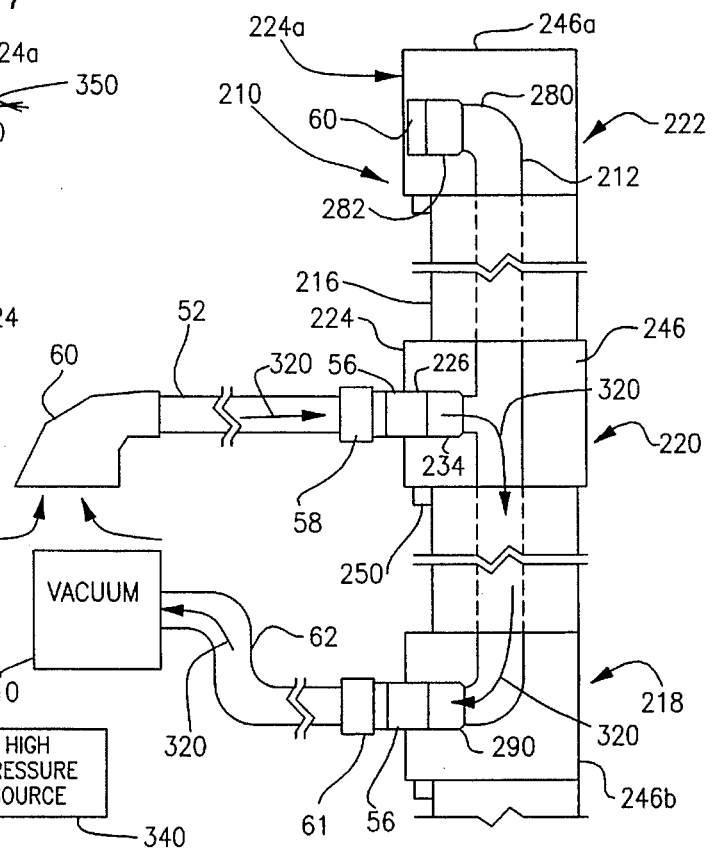
FIG. 6 is a schematic side view of a system that employs the wall mounted units depicted in FIG. 5. In particular, the vacuum cleaning system is shown.

An alternative floor and carpet cleaning system 210 is depicted in FIGS. 5–7. System 210 includes a vacuum conduit 212 and an adjacent raceway 214 that are disposed within a wall 216 of a multiple level building. Typically, wall 216 is constructed of standard concrete blocks that are erected in a conventional manner. In alternative embodiments the building may comprise a poured concrete, steel frame or other form of construction. Conduit 212 and raceway 214 extend vertically through wall 216 and, in particular, are preferably disposed through the aligned openings in the concrete blocks when this type of building construction is employed. Normally, conduit 212 and raceway 214 are installed in the blocks when the building is constructed. As best shown in FIGS. 6 and 7, conduit 212 and raceway 214 extend through a plurality of building levels 218, 220 and 222. Once again, three floors or levels are illustrated, although any other number of intermediate upper levels may be employed between lower level 218 and top level 222.

As illustrated in FIG. 5, an upper vacuum hose connector unit 224 is located on each upper level of the building, i.e. on each level above the ground level. The uppermost level 222 includes a slightly modified connector unit 224, which is described more fully below.

As best shown in FIG. 5, connector unit 224 includes a vacuum inlet 226 and a pair of raceway outlets 238 and 240. The vacuum inlet is formed by installing a T-connector 230 between a pair of straight pipe segments 232. A branch section 234 of T-connector 230 includes a central opening, 236 that communicates with the bore of conduit 212. More specifically, section 234 includes a branch piece 235 that is formed unitarily with the remainder of the T-connector 230. An annular sleeve 237 is mounted permanently within branch 235. An O-ring 239 is formed peripherally about sleeve 237 such that it abuts the distal edge of branch 235. This structure enables a fitting to be attached to the T-connector in a manner similar to that previously described.

Raceway outlets 238 and 240 are defined by a pair of L-shaped pipe elements that are secured in a conventional manner to the lower and upper ends of raceway segments 242. Outlet 238 is angled in a generally downward direction and outlet 240 is angled in a generally upward direction, as is further shown in FIG. 7. Again, PVC pipe is preferred for use in the raceway Unit 224 also includes a housing 246 that encloses inlet 226 and outlets 238 and 240. As illustrated in FIGS. 5–7, housing 246 has a generally cubicle shape with preferred dimensions of approximately 8"×8"×6". The housing, is mounted permanently within the concrete block wall. Housing, 246 include upper and lower openings 254 and 256 that accommodate respective sections 232 of conduit 212. Similarly, housing 246 includes upper and lower apertures 258 and 260 that accommodate respective sections 242 of raceway 214. A tab 250 mounted on the bottom housing 246 engages the front surface of wall 216 and enables the housing to be properly positioned so that the openings and apertures in the housing properly align with the conduit 212 and raceway 214.

As best illustrated in FIG. 5, a front side of housing 246 is open so that convenient access is provided to inlet 226 and outlets 238 and 240. A door 268 is pivotably mounted to housing 246 by hinges 270. Although piano hinges are illustrated, in alternative embodiments, various other types of hinges may be utilized. Door 268 has a size and shape that match the open side of housing 246. When the vacuum inlet 226 and the raceway outlets 238 and 240 are not in use, door 268 is pivoted shut to fully enclose the housing. Complementary magnetic elements 272 and 274 are mounted on the edge of the housing and the door, respectively, to hold the door closed when it is shut.

As shown in FIGS. 6 and 7, an additional housing 246*a* is mounted in the wall of the upper level 218 in a manner similar to that described above. The only distinction between housing 246*a* and housing 246 is that the former housing lacks openings and apertures in its upper surface because the raceway and vacuum conduits do not extend through that upper surface. Instead, vacuum conduit 212 terminates in an L-shaped element 280 having a transverse branch portion 282. The upper end of raceway 214 similarly includes an angled pipe section 284, FIG. 7, that is angled upwardly. Because no higher levels are involved, a downwardly angled pipe section, similar to outlet section 238 is not required.

Still another housing 246*b* is mounted in the wall at ground level 218. In contrast to the upper housing 246*a*, lowermost housing 246*b* includes an opening and aperture in its upper surface, which accommodate a lower L-shaped vacuum outlet 290, FIG. 6, and a downwardly angled raceway outlet 292, FIG. 7.

It should be noted that vacuum inlets 226 and 280 and vacuum outlet 290 are constructed analogously to and closely resemble the vacuum inlets and outlets of the previously described embodiment. In particular, when vacuuming on a particular floor is required, that floor's inlet employs a fitting 56, which is attached to transverse pipe section 234 in a manner similar to that described in connection with FIGS. 1–4. Fitting 56 extends through the open front side of housing 246 and the door, not shown, remains open to accommodate the fitting. A vacuum plug 58 attaches to the opposite end of fitting 56 so that vacuum hose 52 is communicably interconnected to vacuum conduit 212. An identically constructed fitting 56 interengages lower pipe element 290 so that vacuum end plug 61 and vacuum hose 62 are communicably connected to a lower end of the vacuum conduit.

The vacuum cleaning system of FIG. 6 operates in a manner similar to that of the previously described embodiment. In particular, vacuum apparatus 310 is connected through hose 62, fitting 56 and pipe element 290 to the lower end of the vacuum conduit. Vacuum hose 52 is similarly connected to an inlet 226 located on the floor or level to be vacuumed. In FIG. 6, this is level 220. On the remaining levels, represented by level 222, a vacuum is not engaged with the inlet. At those levels, the fitting 56 is removed from the transverse section of pipe and a plug or closure 60 is fitted on the inlet. Again, when a different floor is to be vacuumed, the hose 52 and fitting 56 are removed from the vacuum connector unit 224 and are attached in an analogous manner to the vacuum connector unit 224 or 224*a* located on the floor to be vacuumed. To access the inlet for attachment of the vacuum hose, the door 268 is simply opened. Subsequently, when vacuuming is completed, the vacuum and fitting are detached from the inlet, cap 60 is replaced over the inlet and the door is closed.

A conventional vacuum apparatus 310 is operated to create a suction. As a result, dirt and debris are drawn into hose 52 through a nozzle 59. As illustrated by arrows 320, the dirt is drawn through the conduit and into hose 62 and vacuum apparatus 310. Periodically, the vacuum is emptied and the dirt and/or debris is transported to a waste site. During this operation, element 280 and any of the other inlets on levels that are not shown, remain capped or closed. After vacuuming of level 220 is completed, vacuum hose 52 and fitting 56 may be moved to any other upper level of the building and attached with the vacuum connector unit therein so that vacuuming of that level may be accomplished. After vacuuming is completed in level 220, a cap or closure is attached to inlet 226 and, in particular, to the distal end of transverse pipe section 234.

In FIGS. 5 and 7, a pressure hose or solution line 330 is deployed through raceway 214. Line 330 is a standard high pressure solution line that is used in carpet cleaning applications. Normally, the most common way to deploy line 330 is to transport the line to the level to be cleaned. High pressure water source 340 is typically located at or about the ground level of the building. Accordingly, the end of line 330 that is to be attached to water source 340 is lowered through respective sections of raceway 214 until that end reaches the ground level 218. In housing 246*a*, line 330 is introduced into outlet 284. In each lower level's housing 246 the line exits from the downwardly facing outlet 238 and re-enters the upwardly facing outlet 240. Finally, at the ground level 218, line 330 exits outlet 292 and is attached to water source 340. The entire solution line is run through the wall mounted raceway system and it does not drape over the exterior of the building or dangle through windows and trash chutes. Rather, the high pressure line remains neatly and conveniently out of the way and is much easier to handle. When washing of top level 222 is completed, the maintenance personnel can move the line 330 to the next lower level 220 simply by lowering the line through upper outlet 284 and downwardly through raceway 214 until the sprayer end 350 exits outlet 238. The sprayer is then deployed from housing 246 into level 220 where high pressure cleaning is performed. Alternatively, as shown in FIG. 5, the entire line 330*a* may be transported to level 220 and the lower end of the hose deployed downwardly through the raceway via the outlet 240.

In still other alternative embodiments, discrete raceway sections need not be utilized. Instead, a single continuous raceway may be utilized with a single outlet formed within each housing. The configuration shown in FIG. 7 is preferred, however, because it enables the high pressure line to be lowered conveniently without multiple trips up the building for the purpose of re-lowering the line at each level. Additionally, it is much more convenient to lower the high pressure line than to raise the line against gravity up through the raceway. Other embodiments may employ a solution line that is disposed permanently in the raceway.

Figure 8:
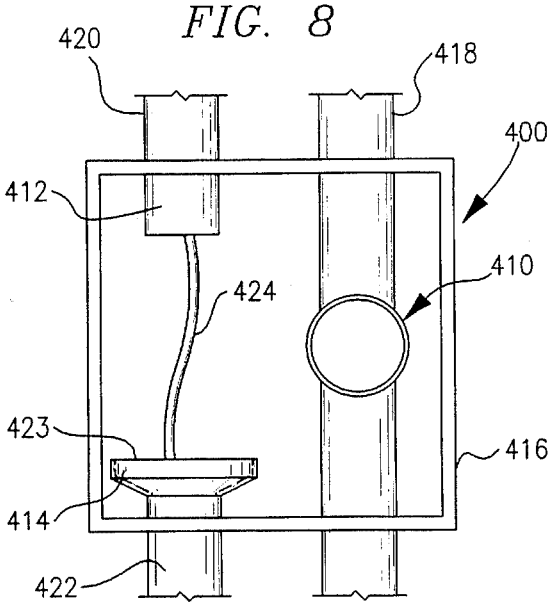
FIG. 8 is a simplified elevational view of a wall mounted unit that includes an alternative raceway outlet for the solution line.

FIG. 8 depicts an alternative wall unit 400 that may be substituted for unit 224 shown in FIG. 5. Unit 400 includes a vacuum inlet 410 and raceway outlets 412 and 414 that are disposed within a housing 416. Vacuum inlet 410 is communicably connected to the vertical vacuum conduit 418. This conduit is analogous to those previously described in connection with this invention. Similarly, outlets 412 and 414 are respectively formed in the lower and upper ends of raceway pipe segments 420 and 422, respectively. Outlet 414 includes an enlarged mouth 423. Mouth 423 effectively receives a solution line 424 that is lowered downwardly from segment 420. As in the embodiment of FIG. 5, the solution line may be lowered from the floor on which unit 400 is mounted simply by introducing the line into housing 416 and through outlet 414.

Figure 9:
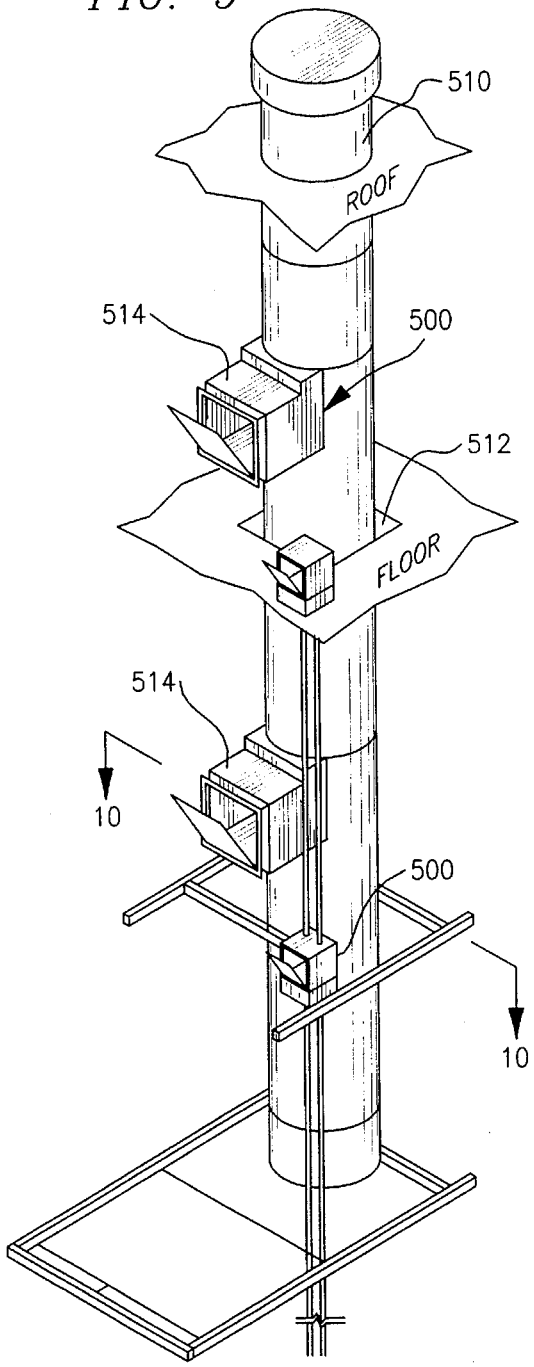
FIG. 9 is a partial perspective view of the system of this invention incorporated into the passageway which accommodates a vertical trash chute.
Figure 10:
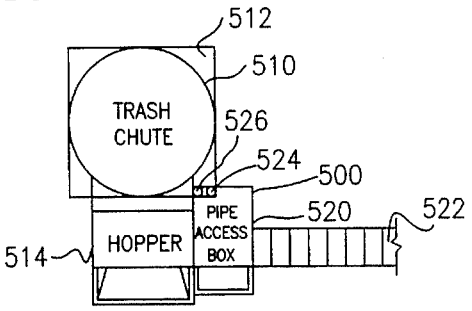
FIG. 10 is a cross sectional view taken along line 10—10 of FIG. 9.
Figure 11:
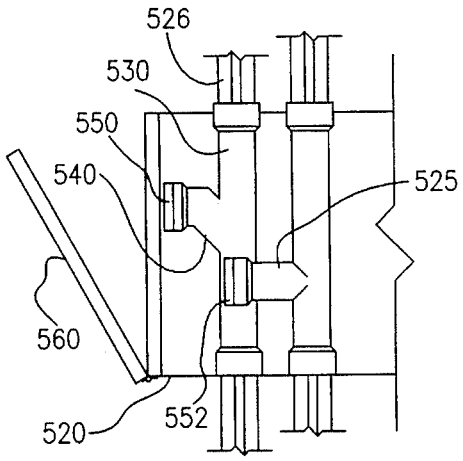
FIG. 11 is a simplified elevational view of an alternative wall unit according to this invention.

As illustrated in FIGS. 9–11, a wall unit 500, according to this invention, may be mounted exteriorly adjacent to a conventional trash chute 510 that extends vertically through the multiple levels of a high rise building. Aligned openings are formed through the respective floors to at least partly define a vertical passageway 512 for accommodating chute 510. This passageway may be enclosed by the interior and exterior walls of the building. A trash receiving hopper 514 is operably mounted to trash chute 510 and exposed through either the interior or exterior wall of the building, on each of the respective levels.

Each wall unit 500 includes an access box or housing 520, analogous to the housings previously described herein. As best shown in FIG. 10, this unit is mounted to the inside wall 522 of the building such that its front face is exposed through the inside surface of the wall. Housing 520 extends rearwardly such that its rearward end extends into passageway 512. A vacuum conduit 524 and a solution line 526, constructed in the manner previously described, extend through each of the units 500 proximate the rearward end of housing 520 such that they extend vertically through passageway 512. The vacuum conduit 524 and the solution line 526 are thereby disposed exteriorly adjacent to trash chute 510 and extend through the passageway that accommodates the trash chute. The lower ends of the solution line and the vacuum conduit are constructed in the manner previously described and are operably connected to a vacuum and a high pressure water source, respectively, as shown in FIGS. 6 and 7.

FIG. 11 depicts an alternative construction for an outlet 530 of solution line raceway 526. In this embodiment, only a single outlet is mounted within housing 520. A generally Y-shaped connector piece 540 is joined between upper and lower branch pieces of the solution line raceway. Caps 550 and 552 are secured to the vacuum inlet 525 and the solution line outlet 530, respectively, when the inlet and outlet are not in use. In this embodiment, a door 560 is hingedly connected to the lower edge of housing 520.

In all other manners, the latter embodiment operates analogously to the previously described embodiments. It utilizes the pre-existing trash chute and trash chute passageway as a raceway for the vacuum conduit and solution line raceway. As a result, these elements are mounted securely and unobtrusively within the building and are hidden from view. At the same time, extensive work is not required to form raceways through the walls of the building. This version is therefore convenient to retrofit existing high rise buildings having a trash chute and trash chute passageway.

Accordingly, this invention provides a highly efficient centralized cleaning system for multiple story buildings. The vacuum attachment and high pressure solution line ingress are conveniently located on each level of the building and are neatly formed against or within the walls of the building. Access is preferably provided through a convenient, attractive and centrally located enclosure. Time and effort in cleaning the carpets and floors of the building are reduced and janitorial maintenance is greatly facilitated.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A floor and carpet cleaning system for multiple level buildings, said system comprising:

a conduit mounted in a wall of the building, between an interior surface and an exterior surface of said wall, said conduit being separate from and extending vertically through a vertical passageway, which passageway is formed between said interior and exterior surfaces of said wall and extends through a plurality of levels of the building;

at least two upper vacuum hose connector units, each of said upper vacuum hose connector units being disposed in a corresponding upper level of the building, including an inlet connected to said conduit and being communicably and releasably engaged with one end of a first vacuum hose, said first vacuum hose having an intake nozzle attached at an opposite second end thereof, and a housing permanently mounted in the wall of the building and at least partly enclosing said inlet, said housing having an opening which enables said first vacuum hose to be interengaged with said inlet;

a lower vacuum hose connector unit disposed in a level of the building below the upper levels, lower vacuum hose connector unit including an outlet connected to said conduit and being communicably and releasably engaged with one end of a second vacuum hose, said second vacuum hose having an opposite end that is engaged with a vacuum apparatus, which apparatus is operated to create a suction which draws dirt and debris into said apparatus through said system;

raceway means for removably accommodating a solution line therethrough, said raceway means being mounted in said walls of said building adjacent to said conduit means and extending through said passageway and a solution line removably disposed within said raceway means.

2. The system of claim 1 in which said housing includes a door for selectively closing said opening when said hose is detached from said conduit.

3. The system of claim 1 in which said inlet includes a pipe section that extends transversely from said conduit.

4. The system of claim 3 in which said inlet includes a fitting having a passageway for communicably interconnecting said pipe section with said first end of said first hose.

5. The system of claim 4 in which said pipe section includes an insertible portion and said fitting includes, at one end, a mouth for receiving said insertible portion and, at the other end, means for communicably interengaging said first end of said first hose.

6. The system of claim 1 in which said means for closing includes a cap that is releasably engaged with said inlet.

7. The system of claim 1 in which said raceway means extend through said housing and includes raceway outlet means for removably receiving a solution line therethrough, said raceway outlet means being disposed in each of said plurality of housings adjacent to said inlet.

8. The system of claim 7 in which each said raceway outlet means include a pipe segment that is connected and extends transversely from said raceway means.

9. The system of claim 8 in which at least one pipe segment is disposed at an upward angle from said raceway means.

10. The system of claim 8 in which at least one pipe segment is disposed at a downward angle from said raceway means.

11. The system of claim 1 further including means for selectively closing said inlet when said first vacuum hose is disengaged therefrom.

12. The system of claim 1 in which said outlet includes a pipe section that extends transversely from said conduit and a fitting having a passageway for communicably interconnecting said pipe section with said second vacuum hose.

13. The system of claim 12 in which said fitting is permanently secured to said pipe section of said outlet.

14. A floor and carpet cleaning system for a multiple level building, which building has a trash chute and a trash chute passageway formed vertically in a wall of the building and extending through a plurality of levels of the building, said system comprising:

a conduit mounted in a wall of the building and extending through said trash chute passageway and exteriorly adjacent to said trash chute such that said conduit extends through a plurality of levels of the building;

at least two upper vacuum hose connector units, each of said upper vacuum hose connector units being disposed in a corresponding upper level of the building, including an inlet connected to said conduit means and being communicably and releasably engaged with one end of a first vacuum hose, said first vacuum hose having an intake nozzle attached at an opposite second end thereof, and a housing permanently mounted in the wall of the building and at least partly enclosing said inlet, said housing having an opening which enables said first vacuum hose to be interengaged with said inlet;

a lower vacuum hose connector unit disposed in a level of the building below the upper levels, said lower vacuum hose connector unit including an outlet connected to said conduit and being communicably and releasably engageable with one end of a second vacuum hose, said second vacuum hose having an opposite end that is engaged with a vacuum apparatus, which apparatus is operated to create a suction which draws dirt and debris into said apparatus through said system;

raceway means for removably accommodating a solution line therethrough, said raceway means being mounted in said walls of said building adjacent to said conduit and extending through said trash chute passageway and a solution line removably disposed within said raceway means.

15. The system of claim 14 in which said vacuum apparatus is mounted in a mobile service vehicle.

16. A vacuum cleaning system for a building having at least three levels, said system comprising:

conduit means that are mounted to the building and arranged vertically to extend through at least three levels of the building;

at least two vacuum inlets connected to said conduit means, each said inlet being disposed in a corresponding upper level of the building and being communicably and releasably engaged with one end of a first vacuum hose, said first vacuum hose having an intake nozzle attached at an opposite end thereof;

a vacuum outlet connected to said conduit and disposed in a lower level of the building below the upper levels, said outlet being communicably and releasably engaged with one end of a second vacuum hose, said second vacuum hose having an opposite end that is engaged with a vacuum apparatus, which apparatus is mounted in a mobile service vehicle, said vacuum apparatus being operated to create a suction which draws dirt and debris into said vacuum apparatus through said system;

raceway means for removably accommodating a solution line therethrough, said raceway means being mounted in said walls of said building adjacent to said conduit means and a solution line removably disposed within said raceway means.

17. The system of claim 16 in which said vacuum apparatus is mounted in a mobile service vehicle.

* * * * *